US005296839A

United States Patent [19]

Lu

[11] Patent Number: 5,296,839

[45] Date of Patent: Mar. 22, 1994

[54] SOUND GENERATING APPARATUS

[76] Inventor: Clive S. Lu, 282 Newbridge Rd., Hicksville, N.Y. 11801

[21] Appl. No.: 927,742

[22] Filed: Aug. 10, 1992

[51] Int. Cl.[5] ..... G08B 3/00

[52] U.S. Cl. ..... 340/384.6; 340/388.1

[58] Field of Search ..... 340/384 E, 384 R, 388, 340/387, 391; 381/90, 188, 190; 446/297, 397, 404; 200/520, 292

[56] References Cited

U.S. PATENT DOCUMENTS 4,550,429 10/1985 Burbank et al. ..... 381/90
4,810,997 3/1989 Kudo et al. ..... 340/384 E
4,973,941 11/1990 Davis et al. ..... 340/384 E

*Primary Examiner*—Donnie L. Crosland
*Attorney, Agent, or Firm*—King & Schickli

[57] ABSTRACT

An electronic sound generating apparatus includes a housing having a closed end and a sidewall defining a cavity. The sidewall also includes a series of radially arrayed sound radiating ports. A circuit board with power source, a sound generating element electronically connected to the circuit board and a sound reflector are all received in the cavity. The sound reflector includes a substantially conical face axially aligned within the cavity and directed toward the sound generating element. This face serves to radially reflect the sound from the sound generating element through the series of sound radiating ports. A touch plate and normally open switch are also housed in the cavity with all the components maintained in position by means of a retaining ring. The switch may include a pair of spaced, relatively stationary contacts mounted to the sound reflector as well as a collapsible or compressible trigger member with a relatively displaceable contact. When the touch plate is depressed, the displaceable contact engages and bridges across the stationary contacts to close the switch and actuate the sound generating apparatus.

12 Claims, 1 Drawing Sheet

Fig. 1
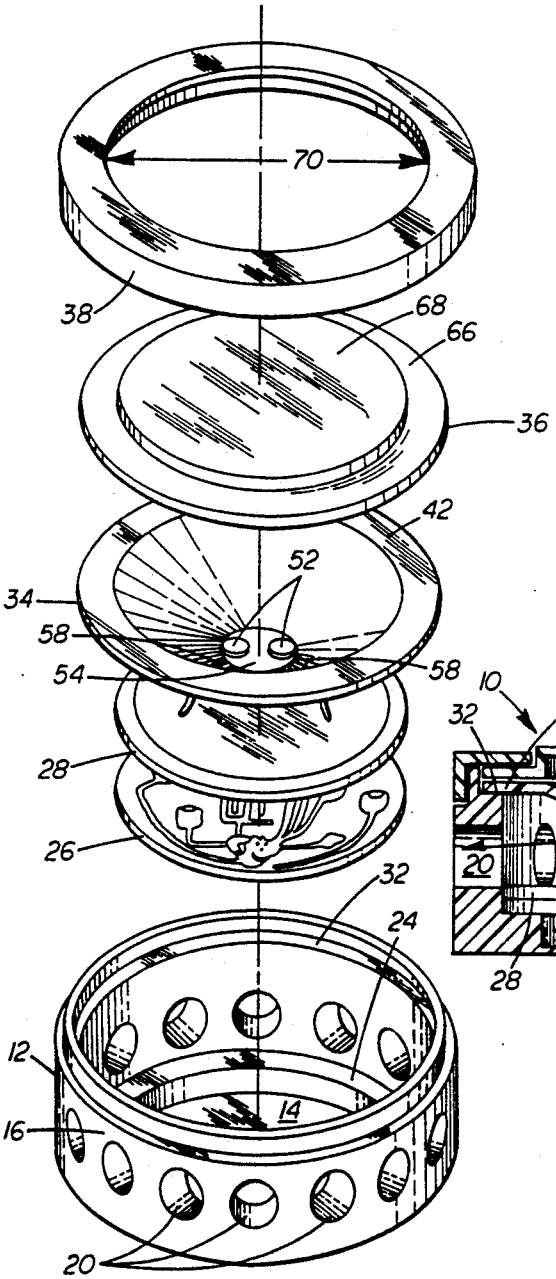
Fig. 3
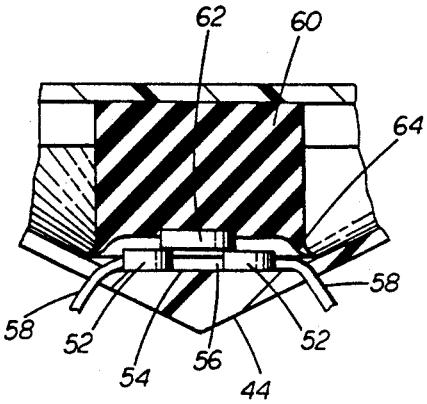
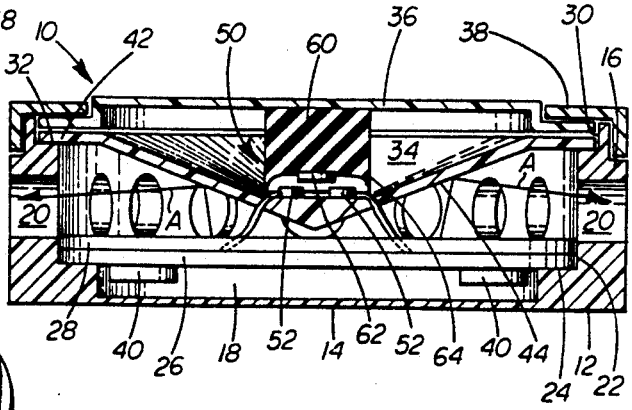
Fig. 2

SOUND GENERATING APPARATUS

TECHNICAL FIELD

The present invention relates generally to electronic sound generating devices and, more particularly, sound generating devices that are relatively small in size and adapted to be incorporated into various objects such as stuffed dolls or the like.

BACKGROUND OF THE INVENTION

Small electronic sound generating devices are well known in the art. Examples of such devices are disclosed in U.S. Pat. Nos. 4,810,997 to Kudo et al. and 4,973,941 to Davis et al.

The sound generating device disclosed in the Kudo et al. patent includes a three piece housing comprised of a holding plate sandwiched between a cover and a touch plate case. A piezoelectric buzzer is retained between the cover and the holding plate and a circuit board is retained between the holding plate and the touch plate case. A sound radiating port is provided in the back or rear end of the device opposite the touch plate that is depressed to actuate the device.

The location of the sound radiating port on the rear end of the housing has its drawbacks. More particularly, as the touch plate must be positioned adjacent a surface of, e.g. the stuffed animal, to allow activation of the device, the sound radiating from the rear of the device typically must travel through the stuffed toy. The resulting muffling effect of the stuffed toy makes the sound being generated difficult to hear. Accordingly, the Kudo sound generating device is only effectively applicable for utilization in relatively small and thin stuffed toys.

In response to this problem, the Davis et al. device includes structure allowing the sound to radiate outwardly through the touch plate on the front face or end of the device. While this addressed the main problem with the design of the Kudo et al. device, the Davis et al. device may also not be appropriate for utilization in all applications. More particularly, in certain instances it may be desirable to have the sound directed radially outward from the side of the device.

SUMMARY OF THE INVENTION

Accordingly, it is a primary object of the present invention to provide an improved electronic sound generating apparatus of relatively simple construction that is simple and economic to manufacture.

Another object of the present invention is to provide an electronic sound generating apparatus that directs the sound generated radially outward with even distribution and good tonal quality. Further, the sound generated is substantially fully reflected through sound radiating ports without substantial internal muffling.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the forging and other objects, and in accordance with the purposes of the present invention as described herein, an imported electronic sound generating apparatus is provided. The apparatus includes a housing preferably having a closed end and a sidewall defining a cavity. A series of radially arrayed sound radiating ports are also provided in the sidewall. A circuit board is received within the cavity in the housing. Preferably, a power source such as batteries are mounted to the circuit board. Further, a sound generating element is received in the cavity in the housing adjacent the circuit board. The sound generating element is operatively electronically connected to the circuit board to provide piezoelectric sound.

A sound reflector is also received within the cavity of the housing adjacent the sound generating element. The sound reflector includes a substantially conical face axially aligned within the cavity and directed toward the sound generating element. Accordingly, sound generated by the element is reflected by the conical face outwardly to and through the sound radiating ports in the sidewall of the housing. Advantageously, substantially all of the sound is reflected through the ports without muffling and an even distribution is provided for both good volume and tonal quality.

The sound generating apparatus is actuated by means of a touch plate that is received in the cavity and mounted for limited axial movement with respect to the housing. A normally open actuator switch is provided including a pair of spaced relatively stationary contacts mounted on the rear face of the sound reflector. A collapsible trigger member is provided between the touch plate and the rear face of the sound reflector. Further, a relatively displaceable contact is mounted to a first end of the trigger member adjacent but normally spaced from the two relatively stationary contacts mounted to the rear of the sound reflector. A retaining ring mounted to the housing holds the circuit board, sound generating element, sound reflector and touch plate in position in the cavity.

The sound generating apparatus is actuated by depressing the touch plate. More particularly, depression of the touch plate causes the trigger member to collapse or compress thereby bringing the displaceable contact into engagement with the spaced stationary contacts. Accordingly, the gap between the stationary contacts is bridged and the circuit is closed actuating the apparatus and beginning the generation of sound. Upon release, the resilient trigger member acts through resilient memory to return to its home position. In the home position the displaceable contact is again spaced from the stationary contacts thereby leaving the circuit in a normally open position.

Preferably, the first end of the trigger member includes an axially projecting annular flange of resilient material that extends around but is spaced from the displaceable contact. Still more preferably, this axial flange is tapered toward a distal end to provide the desired, controlled collapsing or compressing action to allow actuation of the sound generating apparatus. Of course, upon release of the touch plate, the annular flange returns under resilient memory to its original profile bringing the switch once again to the open position.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 1 is a cross-sectional view of the electronic sound generating apparatus of the present invention;

FIG. 2 is an exploded perspective view of the electronic sound generating apparatus shown in FIG. 1; and FIG. 3 is a detailed partially sectional view showing actuation of the apparatus.

Reference will now be made in detail to the present preferred embodiment of the invention, an example of which is illustrated in the accompanying drawing.

DETAILED DESCRIPTION OF THE INVENTION

Reference is now made to drawing FIGS. 1 and 2 showing the electronic sound generating apparatus 10 of the present invention. The apparatus 10 includes a housing 12 preferably molded from a strong lightweight plastic material such as ABS or polycarbonate. As shown, the housing 12 includes an end wall 14 and a cylindrical sidewall 16 defining a cavity 18. A series of radially arrayed sound radiating ports 20 extend through the sidewall 16.

As best shown in FIG. 1, the inner face of the sidewall 16 includes two counterbores. The first, relatively small counterbore 22 defines a lower step 24 for receiving and supporting a circuit board 26 and a piezoelectric sound generating element 28. As is known in the art, the circuit board includes an electronic component for controlling the generation of sound. The second or relatively larger counterbore 30 includes a step 32 for receiving and holding the sound reflector 34 and the touch plate 36. A retaining ring 38 is received over the open end of the housing 12. More specifically, the retaining ring 38 functions to hold the apparatus 10 together and may be secured to the housing 12 by means of mating threads, adhesive, friction fit or any other method known in the art.

More particularly, the sound reflector 34 includes an annular rim 42 particularly adapted for resting upon the step 32. The sound reflector 34 also includes a substantially conical face portion 44 that is directed toward the sound generating element 28. This face 44 serves to reflect sound from the sound generating element outwardly toward and through the sound radiating ports 20 (note action arrows A). Advantageously, the sound travels only a short distance before being deflected. This creates a "piezo effect" that increases the volume of the sound. Further, substantially all of the sound is reflected through the ports without any substantial muting taking place. Additionally, as the face 44 is substantially continuous and axially aligned within the cavity 18, the sound is evenly distributed through the ports 20 in what results in a wide dispersal pattern. Accordingly, crisp, clear sound of good tonal quality is produced. The relatively high volume transmission and the radial dispersal pattern of the sound provides a product uniquely suited to particular applications.

The apparatus 10 is actuated by means of a normally open switch, generally designated by reference numeral 50. As shown, the switch 50 includes a pair of spaced, relatively stationary contacts 52 that are mounted to the rear floor 54 of the sound reflector 34. Accordingly, a gap 56 is formed between the contacts 52. As shown, the contacts 52 also include leads 58 leading to the circuit board 26 powered by the batteries 40. The leads 58 may extend through holes in the reflector 34 as shown or, alteratively, extend along and around the reflector.

As also shown in FIG. 1, the switch 50 includes a compressible or collapsible trigger member 60. Preferably, the trigger member 60 is made from a resilient rubber material and includes a first end holding a relatively displaceable contact 62 and a second, opposite end engaging against the rear face of the touch plate 36. Advantageously, the resilient character of the material from which the trigger member 60 is constructed provides some shock absorption that cushions and absorbs shocks to protect components of the apparatus 10 from damage when receiving rough handling.

As further shown in FIG. 1, the first end of the trigger member 60 also includes an annular flange 64 that is tapered toward the distal end of the flange. This flange 64 is spaced from and extends around the relatively displaceable contact 62. As shown, the flange 64 is of a sufficient height when in its normal, full upstanding profile to provide a gap or space between the relatively displaceable contacts 62 and the pair of stationary contacts 52. Accordingly, in the normal operative or home position, the switch 50 is open.

It is a relatively simple procedure, however, to close the switch 50 and initiate operation of the sound generating apparatus 10. More particularly, as shown the touch plate 36 includes an annular rim that allows mounting of the touch plate on the step 32 between the rim 42 of the sound reflector 34 and the retaining ring 38. The central portion 68 of the touch plate is dome shaped and sized to project upwardly in the opening 70 formed by the retaining ring 38. Thus, it should be appreciated that the dome portion 68 is exposed and may be engaged such as with the finger or thumb. When the dome portion 68 of the touch plate 36 is engaged and depressed, the annular flange 64 of the trigger member 60 folds or collapses to a sufficient extent to allow the relatively displaceable contact 62 to engage the stationary contacts 52 (see FIG. 3). Accordingly, the gap 56 between the contact 52 is bridged and the switch 50 is closed thereby activating the sound generating apparatus 10. Upon the release of pressure from the touch plate 36, the resilient memory of the material causes the flange 64 to return to its normal upstanding profile and therefore the relatively displaceable contact 62 to return to its home position. In that position the contact 62 is spaced from the contacts 52 and the switch is again open.

The sound generating apparatus 10 of the present invention is reactively easy to produce. More particularly, the stationary contacts 52 are mounted to the sound reflector 34. The distal end of the leads 58, extending from the circuit board 26, are then extended through apertures in the sound reflector 34 and connected to the contacts 52. The sound generating element 28 may then be mounted to the circuit board so as to form a first subassembly. This subassembly is then positioned in the housing 12 with the circuit board 26 and sound generating element 28 resting on the first step 24 and the rim 42 of the sound reflector 34 resting on the step 32. A second subassembly comprising the touch plate 36, trigger member 60 and displaceable contact 62 is then positioned in the cavity 18 of the housing 12 with the outer rim 66 overlying the outer rim 42 of the sound reflector 34. Next the retaining ring 38 is secured in position to hold the apparatus 10 together.

In summary, numerous benefits have been described which result from employing the concepts of the present invention. Advantageously, the electronic sound generating apparatus 10 of the present invention includes a sound reflector 32 and radially arrayed sound ports 20 in a sidewall 16 of the housing 12 that provide wide, even distribution of clear undistorted sound of high tonal quality. The resulting wide dispersion pattern is of particular advantage for certain applications of this type of device.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An electronic sound generating apparatus comprising:

a housing including a sidewall defining a cavity and a series of sound radiating ports;

a circuit board received in said cavity of said housing;

a sound generating element received in said cavity of said housing and electrically connected to said circuit board;

a sound reflector received in said cavity of said housing adjacent said sound generating element, said sound reflector including means for radially reflecting sound from said sound generating element through said series of sound radiating ports;

a touch plate received in and mounted for limited axial movement with respect to said housing;

switch means for activating said electronic sound generating apparatus in response to depression of said touch plate; and a retaining ring mounted to said housing to hold said circuit board, sound generating element, sound reflector and touch plate in said cavity.

2. The electronic sound generating apparatus set forth in claim 1, wherein said means for radially reflecting sound includes a substantially conical surface axially aligned within said cavity and operatively facing said sound generating element.

3. The electronic sound generating apparatus set forth in claim 1, wherein said switch means includes a pair of actuator contacts mounted to said sound reflector element, said contacts being spaced from each other so as to provide a gap therebetween and a normally open circuit.

4. The electronic sound generating apparatus set forth in claim 3, wherein said switch means includes a displaceable contact for bridging the gap between said actuator contacts and closing said circuit and a trigger member, said displaceable contact being mounted to a first end of said trigger member.

5. The electronic sound generating apparatus set forth in claim 4, wherein a second opposite end of said trigger member engages said depressible touch plate, said touch plate including a projecting dome portion that extends through a central opening in said retaining ring.

6. The electronic sound generating apparatus set forth in claim 5, wherein said first end of said trigger member includes an axially projecting annular flange of resilient material extending around and spaced from said displaceable contact.

7. The electronic sound generating apparatus set forth in claim 6, wherein said annular flange is tapered toward a distal end; depression of said touch plate serving to collapse said tapered annular flange and displace said displaceable contact into engagement with said actuator contacts, bridging said gap and closing said circuit; resilient memory of said annular flange serving to restore the profile of said axially projecting annular flange and displace said displaceable contact to a home position spaced from said actuator contacts and opening said circuit.

8. An electronic sound generating apparatus, comprising:

a housing including a closed end and a sidewall defining a cavity, said sidewall also including a series of radially arrayed sound radiating parts;

a circuit board and power source received in said cavity of said housing;

a sound generating element received in said cavity of said housing and electronically connected to said circuit board;

a sound reflector received in said cavity of said housing adjacent said sound generating element, said sound reflector including a substantially conical face axially aligned within said cavity and directed toward said sound generating element for radially reflecting sound from said sound generating element through said series of sound radiating ports;

a touch plate received in and mounted for limited axial movement with respect to said housing;

switch means for actuating said apparatus including a pair of spaced relatively stationary contacts mounted to said sound reflector, a trigger member having first and second ends and a relatively displaceable contact mounted to said first end of said trigger member; and a retaining ring mounted to said housing to hold said circuit board, sound generating element, sound reflector, switch means and touch plate in said cavity.

9. The electronic sound generating apparatus set forth in claim 8, wherein said housing includes a first counterbore for receiving said circuit board and sound generating element and a second counterbore for receiving said sound reflector, touch plate and retaining ring.

10. The electronic sound generating apparatus set forth in claim 8, wherein said first end of said trigger member includes an axially projecting annular flange of resilient material extending around and spaced from said displaceable contact.

11. The electronic sound generating apparatus set forth in claim 10, wherein said second end of said trigger member engages said touch plate, said touch plate including a projecting dome portion that extends through a central opening in said retaining ring.

12. The electronic sound generating apparatus set forth in claim 11, wherein said annular flange is tapered toward a distal end; depression of said touch plate serving to collapse said tapered annular flange and displace said displaceable contact into engagement with said actuator contacts, bridging said gap and closing said circuit; resilient memory of said annular flange serving to restore the profile of said axially projecting annular flange and displace said displaceable contact to a home position spaced from said actuator contacts and opening said circuit.

* * * * *